US005626676A

United States Patent [19]

Voswinckel

[11] Patent Number: 5,626,676

[45] Date of Patent: May 6, 1997

[54] SIZING APPLICATOR

[75] Inventor: Gerhard Voswinckel, Aachen, Germany

[73] Assignee: Sucker-Muller-Hacoba GmbH & Co., Moenchengladbach, Germany

[21] Appl. No.: 570,123

[22] Filed: Dec. 11, 1995

[30] Foreign Application Priority Data

Dec. 20, 1994 [DE] Germany ..... 44 45 478.3

[51] Int. Cl.[6] ..... B05C 1/00

[52] U.S. Cl. ..... 118/712; 118/117; 118/119; 118/122; 118/123; 118/126; 118/224; 118/249; 118/255; 118/262

[58] Field of Search ..... 118/664, 712, 118/117, 119, 122, 123, 126, 224, 249, 255, 262, 414; 68/22 B, 43; 427/211, 428

[56] References Cited

U.S. PATENT DOCUMENTS

| | | | |
|---|---|---|---|
| 2,170,140 | 8/1939 | Grupe | 427/428 |
| 3,519,460 | 7/1970 | Erb | 118/119 |
| 5,447,566 | 9/1995 | Loiacono | 118/255 |

FOREIGN PATENT DOCUMENTS

| | | | |
|---|---|---|---|
| 726633 | 1/1966 | Canada | 118/414 |
| 3145342A1 | 5/1983 | Germany . | |
| 4118076A1 | 12/1992 | Germany . | |

*Primary Examiner*—Laura Edwards
*Attorney, Agent, or Firm*—Shefte, Pinckney & Sawyer

[57] ABSTRACT

A sizing applicator with two pairs of rollers arranged in sequence with one another along the transport path of a yarn sheet can be converted, without changing the position of the pairs of rollers, between an operating mode as a pad-type sizing applicator and a squeezing-type sizing applicator. Each pair of rollers has a defined gap at a common tangent therebetween and each pair of rollers has one roller disposed at a lower elevation than the other roller of the pair. The two roller pairs are relatively arranged such that their respective common tangents intersect beneath the roller pairs approximately midway between the roller pairs. The lower roller of each roller pair is disposed partially in a trough for containing the sizing to be applied to the yarn sheet, and the upper rollers of the two pair of rollers are arranged relative to one another such that the yarn sheet can be passed in a first path of travel between the two pairs of rollers in peripheral contact with each upper roller of each of the roller pairs over a limited circumferential extent and in another path of travel moving downwardly through the gap between the first pair of rollers and then upwardly through the gap of the second pair of rollers.

10 Claims, 1 Drawing Sheet

SIZING APPLICATOR

FIELD OF THE INVENTION

The present invention relates to a sizing applicator for impregnating a yarn sheet guided in web form with a sizing formulation (which may be of any type), and relates more particularly to a sizing applicator having two pairs of rollers with a gap provided between the rollers of each pair and arranged for travel of the yarn sheet through the roller gaps in sequence with one another.

BACKGROUND OF THE INVENTION

An apparatus of this type is disclosed in German Patent Disclosure DE 31 45 342 A1. In order to have the capability at little expense and without disruption of introducing the broadest possible range of different impregnating agents into the individual yarns of the yarn sheet, the impregnating agent or sizing is introduced immediately upstream of and into the gap between each pairs of rollers, where it penetrates the yarns and at the same time is metered in its amount per unit of length of the yarn sheet by means of the roller gap. In an exemplary embodiment, a pair of rollers with a common vertical tangent is followed along the transport path of the yarn sheet by a pair of rollers with a common horizontal tangent. In the area upstream of the particular gap between each pair of rollers (as viewed in the of the direction of travel of the yarn sheet), the sizing is introduced from a supply line aimed into the gap and/or from a trough into which one roller dips. With this known squeezing-type sizing applicator, hot, low-concentration sizing can be applied to the yarns in a warp.

Recently, however, an attempt has been made to use highly concentrated sizings as well, for instance in order to reduce the expenditure of energy in the ensuing drying operation. For this situation, it is proposed in German Patent Disclosure DE 41 18 076 A1 that application of the sizing be accomplished by moving the yarn sheet past a first sizing applicator roller, which contacts one side of the yarn sheet essentially at a tangent over a limited circumferential range, and then moving the yarn sheet with its opposite side past a second sizing applicator roller, again contacting it essentially at a tangent over a limited circumferential range, thus subjecting the yarn sheet to a slop-pad type treatment on both faces. The yarn sheet is then dried and finally wound, for instance onto a warp beam. As contrasted to the aforementioned squeezing-type sizing applicator, the machine just described will be referred to hereinafter as a slop-pad sizing applicator.

In the textile industry, there are warp yarn sheets (or other sheet articles) that can be adequately well-sized with the aid of slop-pad treatment, but there are also warp yarn sheets that can be properly penetrated with the applicable sizing only in a more conventional way, i.e. by means of a dipping and squeezing treatment. The manufacturer who wishes to be able to treat both types of article or yarn sheets must therefore have both squeezing units and slop-pad units available in the manufacturing plant to be used as alternatives, which above all presents considerable problems.

SUMMARY OF THE INVENTION

It is accordingly an object of the present invention to create an apparatus or process capable of performing both a squeezing-type sizing application process, for instance with immersion of the yarn sheet in a trough or into sizing metered through a nip between rollers, or by a slop-pad application method.

According to the present invention, the dual-function sizing applicator has two pairs of rollers, each having a defined gap at a common tangent therebetween, arranged in sequence with one another along the travel path of the yarn sheet. Each pair of rollers has one roller disposed at a lower elevation than the other roller of the pair and the two roller pairs are relatively arranged such that their respective common tangents intersect beneath the roller pairs approximately midway between the roller pairs. The lower roller of each roller pair is disposed partially in a trough for containing the sizing to be applied to the yarn sheet. The upper rollers of each pair of rollers are arranged relative to one another such that the yarn sheet can be passed in a first possible path of travel between the two pairs of rollers in contact with each upper roller of each of the roller pairs generally at a tangent over a limited circumferential extent and can also be passed in another path of travel moving downwardly through the gap between the first pair of rollers and then upwardly through the gap of the second pair of rollers. Preferably, one pair of rollers is located at a higher net elevation in three-dimensional terms than the other pair of rollers.

By means of the present invention, a sizing applicator is created that is universally usable to selectively perform both a squeezing-type sizing application method wherein sizing is done with immersed squeezing rollers and a pad-type application method in which a more minimal sizing application is made to both sides of a yarn sheet, without requiring significant conversion of the apparatus.

Since the apparatus according to the invention and hence the entire associated system is intended to be operated both by the squeezing process and by the slop-pad process, the drying means that follow the impregnation should have a suitable drying capacity is adequate for the relatively pronounced wetting of the yarn sheet when sized by the squeezing process. If a switchover is then made to the pad process, then in any case drying can be accomplished without changing the transport speed of the yarn sheet. For example, the drying temperature can be reduced from 150° C. to 100° C., depending on the degree of wetting to which the yarn sheet may be subjected, which may possibly be half that of the squeezing process.

Preferably, when the path of the yarn sheet is selectively directed through the two roller gaps to accomplish a squeezing-type sizing application, the impregnating solution is delivered to and accumulated in the nip area upstream of the rollers of the first roller pair (as viewed in the yarn transport direction) to accomplish the desired metered application of the impregnating agent. The nip between such pair of rollers can be supplied with the appropriate impregnating agent from a separate line. The lower roller of each pair of rollers can also be provided with an immersion or collecting trough. Hence, the lower roller of the second pair of rollers (viewed in the transport direction) can dip into the impregnating agent in the trough, so that its nip is supplied with the impregnating agent from the trough. Alternatively or additionally, the upper roller of the second pair of rollers may be equipped with an auxiliary doctor roller in order to provide a supplementary metering of the impregnating agent in the nip between the upper roller and the auxiliary doctor roller. The auxiliary doctor roller should be pivotably associated with the respective pair of rollers, so that upon a switchover from squeezing-type size application to the pad-type application the doctor roller can be taken out of operation.

In the pad method wherein, as aforementioned, the yarn sheet follows a transport path that contacts the upper rollers of each of the two pairs of rollers over a limited circumferential extent generally at a tangent, the impregnating agent to be applied is delivered into the nip area at the upwardly facing side of each of the roller pairs to be peripherally carried by the upper roller of each roller pair for application to the yarn sheet at its location of circumferential contact with each upper roller. At each roller pair, this nip-type metering may be effected from a special sizing supply line directed at the nip, or from a trough into which the lower roller of the roller pair is dipped. For safety's sake, at least one collecting pan is preferably positioned below each of the pairs of rollers.

As will thus be understood, the apparatus of the present invention makes it possible to utilize one and the same sequence of two pairs of rollers to execute both a squeezing-type sizing application and a pad-type sizing application. To change from one to the other method, the only alteration needed in the applicator apparatus is to reverse the direction of rotation of the second pair of rollers (as viewed in the transport direction). Optionally, the auxiliary doctor roller should also be pivoted toward or away from the one pair of rollers. No other changes in the actual sizing applicator are necessary.

In principle, the two pairs of rollers may be associated with one another in an arbitrary way; care need merely be taken that, for the pad mode of operation, the yarn sheet can move in successive contact with the two upper rollers over a defined (preferably limited) circumferential range, and, for the squeezing mode of operation, the yarn sheet can be passed first through the gap between one pair of rollers and then through the gap between the other pair of rollers. In practice, the mutual association between the two roller pairs is preferably chosen such that the second pair of rollers in the transport direction is disposed at a higher level in three-dimensional terms than the first pair of rollers. A yarn sheet drawing-in mechanism with a drawing-in roller and an associated contact roller, which for instance is pivotable, can then be associated with the first pair of rollers. Depending on the mutual positioning of the roller pairs, it may also be necessary to change the direction of rotation of the roller drawing-in mechanism upon a transition from one operating mode to the other.

It may also be favorable for each of the two pairs of rollers to be comprised of one rubberized roller and one steel roller, with the upper roller in each pair preferably being a steel roller. As a rule, it is also favorable for the drawing-in roller of the drawing-in mechanism to be rubberized, while the counterpart roller is of steel. The drawing-in roller and all four rollers of the two pairs of rollers should suitably be driven. The contact pressure force of the two pairs of rollers can be adaptable to suit the desired extent of impregnation, especially for the squeezing type of sizing application, by means of a contact pressure device, for instance a pressure cylinder acting preferably upon the rubberized roller of each pair.

The second pair of rollers in the transport direction is preferably followed by a moisture measuring instrument, with which the moisture of the impregnated yarn sheet can be measured. If there is a deviation from a predetermined moisture content value or range, the measuring instrument can appropriately signal the contact pressure means of the two pairs of rollers, via a suitable control device, to increase or reduce the pressing force until the desired value for the moisture content is reached.

Further details of the invention will be explained hereinbelow with reference to the schematic representation of the exemplary embodiments shown in the accompanying drawings.

DESCRIPTION OF THE PREFERRED EMBODIMENTS

Figure 1:
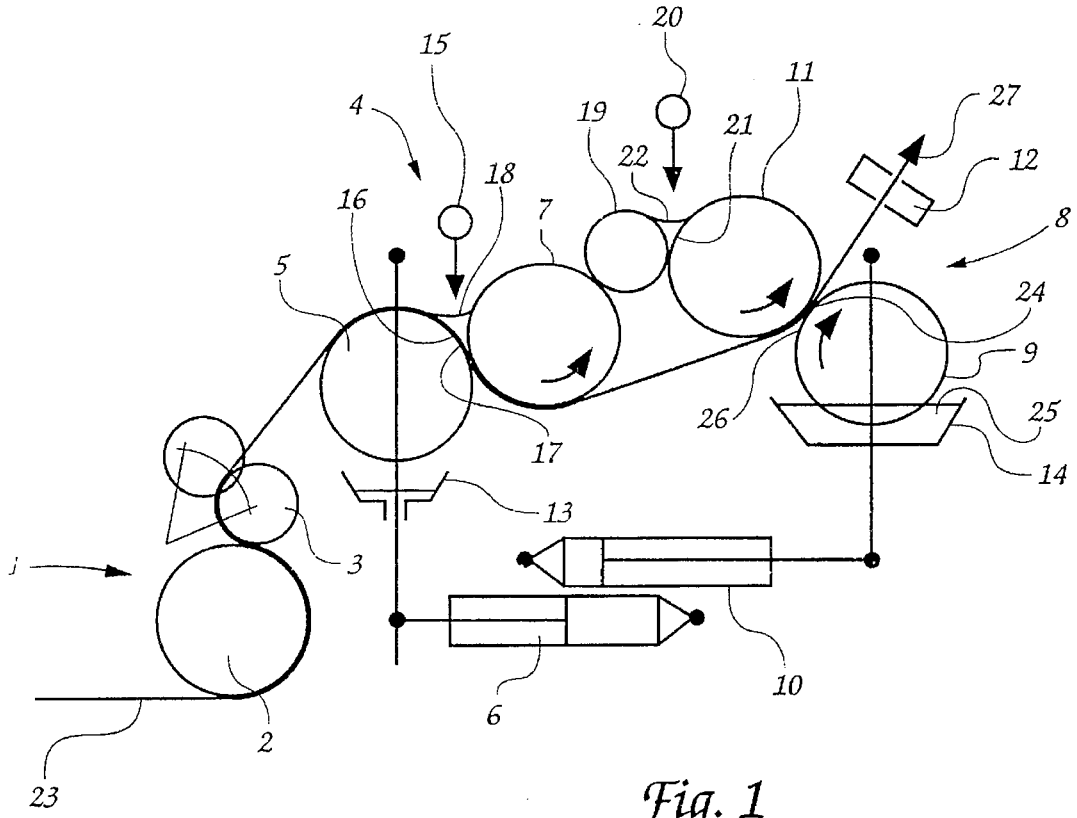
FIG. 1 a schematic side elevational view of a sizing applicator in accordance with the preferred embodiment of the present invention, depicting the arrangement of the applicator for thread-up and processing of a yarn sheet in the squeezing-type mode of operation.
Figure 2:
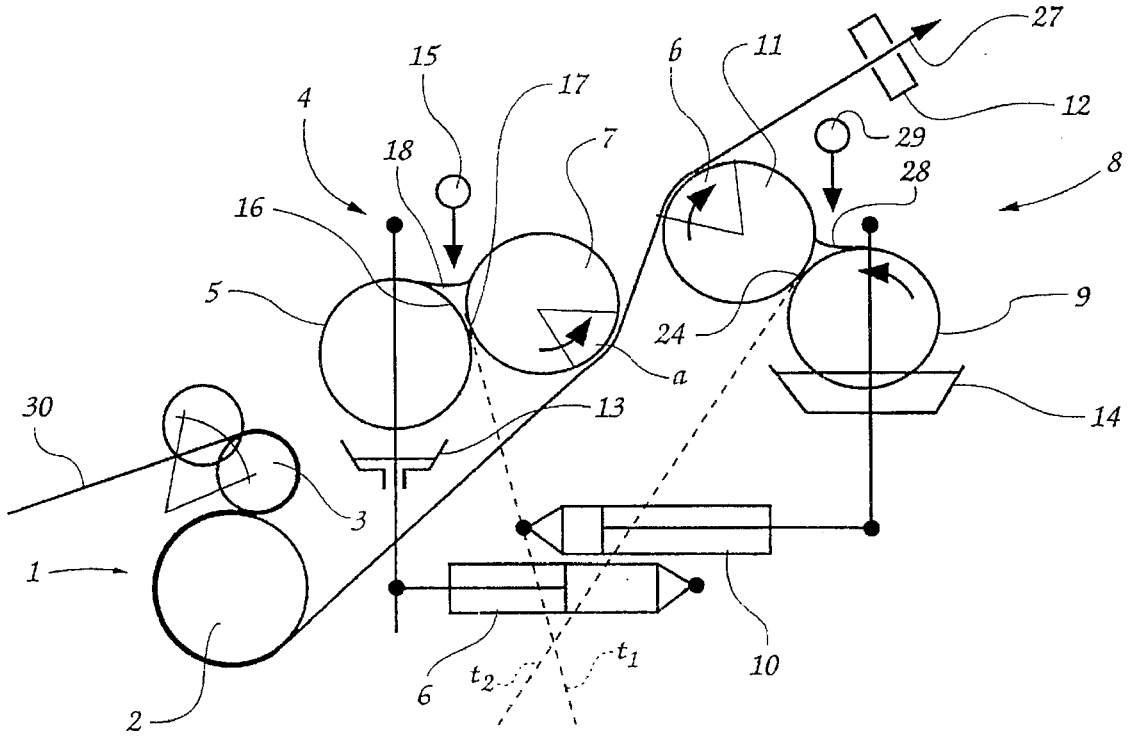
FIG. 2 is another schematic side elevational view of the sizing applicator of FIG. 1, depicting the arrangement of the applicator for thread-up and processing of a yarn sheet in the pad-type mode of operation.

FIGS. 1 and 2 illustrate a preferred arrangement of structural elements for a sizing applicator adapted, in accordance with the present invention as already indicated above, for performing either a squeezing type or pad type of size application to a yarn sheet essentially without modification of the applicator structure. Basically, the applicator structure comprises a yarn drawing-in (feeding) mechanism 1 having a main drawing-in roller 2 with an associated pressure roller 3 pivotably mounted adjacent thereto for parallel movement toward and away from the roller 2. A first pair of size-application rollers 4 is disposed following and slightly above the drawing-in mechanism 1, the roller pair 4 comprising a steel roller 7 rotatably mounted in a fixed disposition and a rubberized roller 5 rotatably mounted parallel thereto on a pressure cylinder mechanism 6 for controlling the spatial relation of the roller 5 by selective movement toward and away from the roller 7. As shown, the fixed steel roller 7 is disposed with its rotational axis at a slight elevation above that of the roller 5. A second pair of size-application rollers 8 is disposed following and slightly above the first roller pair 4, the roller pair 8 likewise comprising a steel roller 11 rotatably mounted in a fixed disposition and a rubberized roller 9 rotatably mounted parallel thereto on a pressure cylinder mechanism 10 for controlling the spatial relation of the roller 9 by selective movement toward and away from the roller 11. Hereagain, the fixed steel roller 11 is disposed with its rotational axis at a slight elevation above that of the roller 9. A moisture-measuring instrument 12 is disposed following and slightly above the second roller pair 8. A liquid containment trough 13, 14 is disposed directly below each of the rubberized rollers 5, 9 of the two pairs of rollers 4, 8. A sizing supply line 15 is disposed above the first pair of rollers 4 for delivering a defined amount of an impregnating agent 18 into the nip area 16 between the rollers 5, 7 above the gap 17 therebetween. Similarly, a sizing supply line 29 may be disposed above the second pair of rollers 8 for supplying a quantity of an impregnating agent into the nip area 28 between the rollers 9, 11 above the gap 24 therebetween.

As shown in FIG. 1, it is additionally contemplated to provide an auxiliary doctor roller 19 adjacent the steel roller 11 of the second pair of rollers 8, with a sizing supply line 20 to supply an impregnating agent 22 to collect in the nip area 21 between the rollers 11, 19. With the exception of the auxiliary doctor roller 19 with the associated supply line 20, all structural elements in FIGS. 1 and 2 are essentially identical. To switch between the squeezing and pad modes of operation, only the direction of rotation of the second pair of rollers 8 is required, as indicated by the different directional arrows in FIGS. 1 and 2. Depending on the mutual spatial disposition of the rollers of the drawing-in mechanism 1 to one another and/or to the first pair of rollers 4, the direction of rotation of the drawing-in rollers 2, 3 may also need to be reversible, as is also represented in FIGS. 1 and 2.

In accordance with FIG. 1, the preferred utilization of the applicator 1 for a squeezing mode of sizing application is depicted. In this mode, a yarn sheet 23 (e.g., a warp comprised of plural individual yarns arranged in side-by-side parallel relation collectively forming a sheet or web-like form) is delivered upwardly by the drawing-in mechanism 1 over the rubberized roller 5 of the first roller pair 4 to travel downwardly through the roller gap 17 between the first pair of rollers, and thus through the impregnating agent 18 collected in the nip area 16 above the roller gap 17. The yarn sheet 23 is subsequently directed below the steel roller 11 of the second roller pair 8 to travel upwardly through the roller gap 24 between the second pair of rollers 8 and out of the sizing device, for example via the moisture-measuring instrument 12, for further processing. In the roller gap 24 of the second roller pair 8, the impregnating agent is applied to the yarn sheet 23 at the nip area 26 upstream of the roller gap 24 via the surface of the rubberized roller 9 which is partially submerged in a quantity of the impregnating agent 25 contained in the trough 14. In addition or in place of such application of impregnating agent, it is possible to supply the nip area 26 with the impregnating agent 22 collected in the nip area 21 between the auxiliary doctor roller 19 and the steel roller 11, via the rotating periphery of the roller 11.

FIG. 2 depicts the identical structural elements as FIG. 1, particularly with respect to the position of the two pairs of rollers 4, 8, with only the direction of rotation of the second pair of rollers 8 being reversed. The two troughs 13, 14 beneath the lowermost rollers 5, 9 of the roller pairs 4, 8 can be used for supplying a quantity of the impregnation agent into the nip areas 18, 28 above the respective rollers gaps 17, 24. Alternatively or additionally, it is also possible to utilize either or both of the supply lines 15, 29 to deliver impregnating agent into each of the nip areas 18, 28.

In accordance with FIG. 2, it is therefore possible to suitably impregnate a yarn sheet 30 in accordance with the pad method of application by feeding the yarn sheet 30 via the drawing-in mechanism 1 to travel initially beneath the first pair of rollers 4 in peripheral, nearly tangentially contact with the upper steel roller 7 over only a limited circumferential region a, and then to travel over the second pair of rollers 8 in similar peripheral, nearly tangential contact with the upper steel roller 11 over only a limited circumferential region b. Using a transport path in accordance with FIG. 2, impregnation as described in German Patent Disclosure DE 41 18 076 A1 mentioned above is possible.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A sizing applicator for impregnating a yarn sheet guided in web form with an impregnating solution, comprising means for delivering impregnating solution to the yarn sheet, and first and second pairs of guide rollers, each pair defining a gap between the rollers thereof at a common tangent therebetween, the first and second pairs of rollers being arranged in sequence with one another along the travel path of the yarn sheet, each pair of rollers having one roller disposed at a lower elevation than the other roller of the pair and the two roller pairs being relatively arranged such that their respective common tangents intersect beneath the roller pairs approximately midway between the roller pairs, the upper rollers of the two pair of rollers being arranged relative to one another such that the yarn sheet can be passed selectively in one of a first path of travel in peripheral contact with each upper roller of each of the roller pairs over limited circumferential extent thereof and a second path of travel moving downwardly through the gap between the first pair of rollers and then upwardly through the gap of the second pair of rollers.

2. The sizing applicator of claim 1, wherein said solution delivering means comprises means for delivering a supply of yarn sheet impregnating solution into a nip area between the first pair of rollers upstream of the roller gap therebetween in the direction of yarn travel in the second path of travel for providing an accumulation of the solution in the roller gap when the second path of the yarn travel is selected.

3. The sizing applicator of claim 2, wherein said solution delivering means further comprises a trough for containing yarn impregnating solution in which at least one of said lower rollers of said roller pairs is partially disposed for delivering impregnating solution to the yarn sheet.

4. The sizing applicator of claim 2, further comprising an auxiliary doctor roller movably disposed in peripherally adjacent relation with the upper roller of the second pair of rollers and wherein said solution delivering means includes means for supplying the impregnating solution into a nip area between the upper roller and the auxiliary doctor roller.

5. The sizing applicator of claim 1, wherein said delivering means includes means for delivering a supply of yarn sheet impregnating solution into a first nip area between the first pair of rollers at the upwardly facing side of the roller gap therebetween and into a second nip area between the second pair of rollers at the upwardly facing side of the roller gap therebetween when the first path of the yarn travel is selected.

6. The sizing applicator of claim 5, wherein the solution delivering means further comprises a solution supply line directed at each nip area.

7. The sizing applicator of claim 5, wherein the solution delivering means further comprises a trough for containing yarn impregnating solution in which at least one of said lower rollers of said roller pairs is partially disposed for delivering impregnating solution to the yarn sheet.

8. The sizing applicator of claim 1, and further comprising a pair of rollers arranged for selectively introducing the yarn sheet to the first pair of rollers in each path of travel.

9. The sizing applicator of claim 1, and further comprising a moisture measuring instrument downstream adjacent the second pair of rollers.

10. The sizing applicator of claim 1, and further comprising means for acting on the lower roller of each pair of rollers for adjusting each gap to control the pressure exerted by the rollers on the yarn sheet in the respective roller gaps.

* * * * *